United States Patent [19]

Evans

[11] Patent Number: 4,886,130

[45] Date of Patent: Dec. 12, 1989

[54] NUTATIONAL TECHNIQUE FOR LIMITING WELL BORE DEVIATION

[76] Inventor: Robert F. Evans, 12820 Montfort, #150, Dallas, Tex. 75230

[21] Appl. No.: 224,464

[22] Filed: Jul. 26, 1988

[51] Int. Cl.[4] ..... E21B 7/10; E21B 17/10

[52] U.S. Cl. ..... 175/73; 175/61; 175/325

[58] Field of Search ..... 175/61, 73, 76, 325

[56] References Cited

U.S. PATENT DOCUMENTS

| | | | |
|---|---|---|---|
| 2,841,366 | 7/1958 | Dunn | 175/325 X |
| 3,352,370 | 11/1967 | Livingston | 175/325 X |
| 3,363,704 | 1/1968 | Farris et al. | 175/61 X |
| 3,825,081 | 7/1974 | McMahon | 175/73 |
| 4,220,213 | 9/1980 | Hamilton | 175/61 X |
| 4,262,758 | 4/1981 | Evans | 175/73 |
| 4,416,339 | 11/1983 | Baker et al. | 175/61 |
| 4,715,453 | 12/1987 | Falgout, Sr. et al. | 175/73 |
| 4,770,258 | 9/1988 | Falgout, Sr. | 175/73 |

FOREIGN PATENT DOCUMENTS

| | | | |
|---|---|---|---|
| 964098 | 10/1982 | U.S.S.R. | 175/325 |
| 1208167 | 1/1986 | U.S.S.R. | 175/61 |

*Primary Examiner*—Hoang C. Dang

*Attorney, Agent, or Firm*—John R. Ley

[57] ABSTRACT

Well bore deviation from vertical is reduced or corrected by inducing a lateral deflection of the drill string at a predetermined location above the drill bit to force the drill bit to return to vertical. The lateral deflection occurs periodically and creates a nutating effect in the drill string which causes the drill bit to angle toward vertical. An eccentrically mounted roller becomes effective when it contacts the low side of a deviated well bore and preferably induces the lateral deflection as it rotates while in contact with the low side of the well bore.

10 Claims, 4 Drawing Sheets

NUTATIONAL TECHNIQUE FOR LIMITING WELL BORE DEVIATION

This invention relates to rotary well bore drilling, and more particularly to a method and apparatus for imparting a selective partial nutating action to a drill string and drill bit to reduce the deviation of the well bore from vertical as it is advanced through an earth formation.

BACKGROUND OF THE INVENTION

In drilling well bores it is often very difficult and costly to maintain the course of the hole or well bore within acceptable limits. Deviation refers to the angle which the well bore departs from the desired course. Although not always the case, most well drilling attempts to achieve a near vertical hole axis or course. Deviation may be caused by many factors, including tilted geological formations which force the bit to deviate in the direction of the tilt, bending of the drill string due to the weight on it, and other influences from the side wall of the well bore.

In those geographic regions where such tilted geological formations are prevalent, many hours or days are spent rotating the bit with substantially reduced weight on it, because reducing the weight on the bit can decrease those influences which tend to increase deviation. Under substantially reduced weight conditions, hole penetration rates are often reduced to one to five feet per hour where normal weight conditions on the bit would achieve 20 to 50 feet per hour. Of course, reducing the penetration rates increases the cost of drilling the well bore, because more hours of rig time will be spent in achieving the depth ultimately desired.

There are sophisticated methods for correcting deviation, but these techniques are seldom economical in drilling wells which are considered marginal producing prospects. Down hole mud motors are very effective in reducing deviation, but such down hole motors are too expensive for use in marginal producing prospects. Whipstocks and multiple stabilizers can also be uneconomical. Most of these correctional techniques require the drilling to be halted, the drill string withdrawn from the well bore by disconnecting the drill pipes one at a time, installing the special correctional equipment, and then reassembling the drill pipes into the drill string. This drill string removal and reinsertion process, known as "tripping", consumes additional time, results in no productive drilling and increases the cost of drilling. Very often another "trip" is required to remove the special correctional equipment after the deviation has been corrected.

SUMMARY OF THE INVENTION

The technique of the present invention offers an economical alternative to some of the prior expensive techniques for correcting bore hole deviation. The present invention can be practiced without substantially reducing the weight on the bit to thereby maintain cost-effective penetration rates and will become operative automatically without "tripping" to install special equipment. Use of the present invention may make prospecting for marginal or submarginal resources more profitable, as a result of being able to better control the course of the well bore.

The major aspect of the present invention involves inducing a periodic lateral deflection in the drill string off of the low side of the side wall of the deviated well bore, thereby causing a partial nutating effect in the drill string. At the bottom end of the drill string where the drill bit is connected, the partial nutation has the effect of angling the drill string and drill bit toward vertical, thus correcting or reducing the amount of deviation.

Apparatus for accomplishing the lateral deflection and partial nutating effect preferably takes the form of a roller which is rotationally positioned on the drill string at a location where the influence of gravity and weight on the drill string would normally bow the drill string into contact with the low side of the side wall of the deviated well bore. Means associated with the roller periodically extends it as the roller comes in contact with the low side of the side wall, thereby forcing or inducing the drill string rotational axis away from the side wall. A bowing effect in the drill string is created, and the bowing effect angles the lower portion of the drill string and the drill bit toward vertical to cause the bit to advance in a direction which corrects or reduces the amount of deviation.

When the well bore advances on a vertical course and the well bore returns to vertical, no lateral impulses or deflections are imparted to the drill string. Thus, the present invention becomes automatically effective upon the occurrence of a deviated well bore and becomes ineffective when the well bore course returns to vertical. Because it operates with respect to the low side of the side wall of the deviated well bore, the partial nutating effect inherently operates in the proper direction to correct or reduce the amount of deviation.

The actual scope of the present invention is defined by the appended claims. The invention may be more readily appreciated from the following detailed description of the preferred embodiment, taken in conjunction with the accompanying drawings.

DETAILED DESCRIPTION

Figure 1:
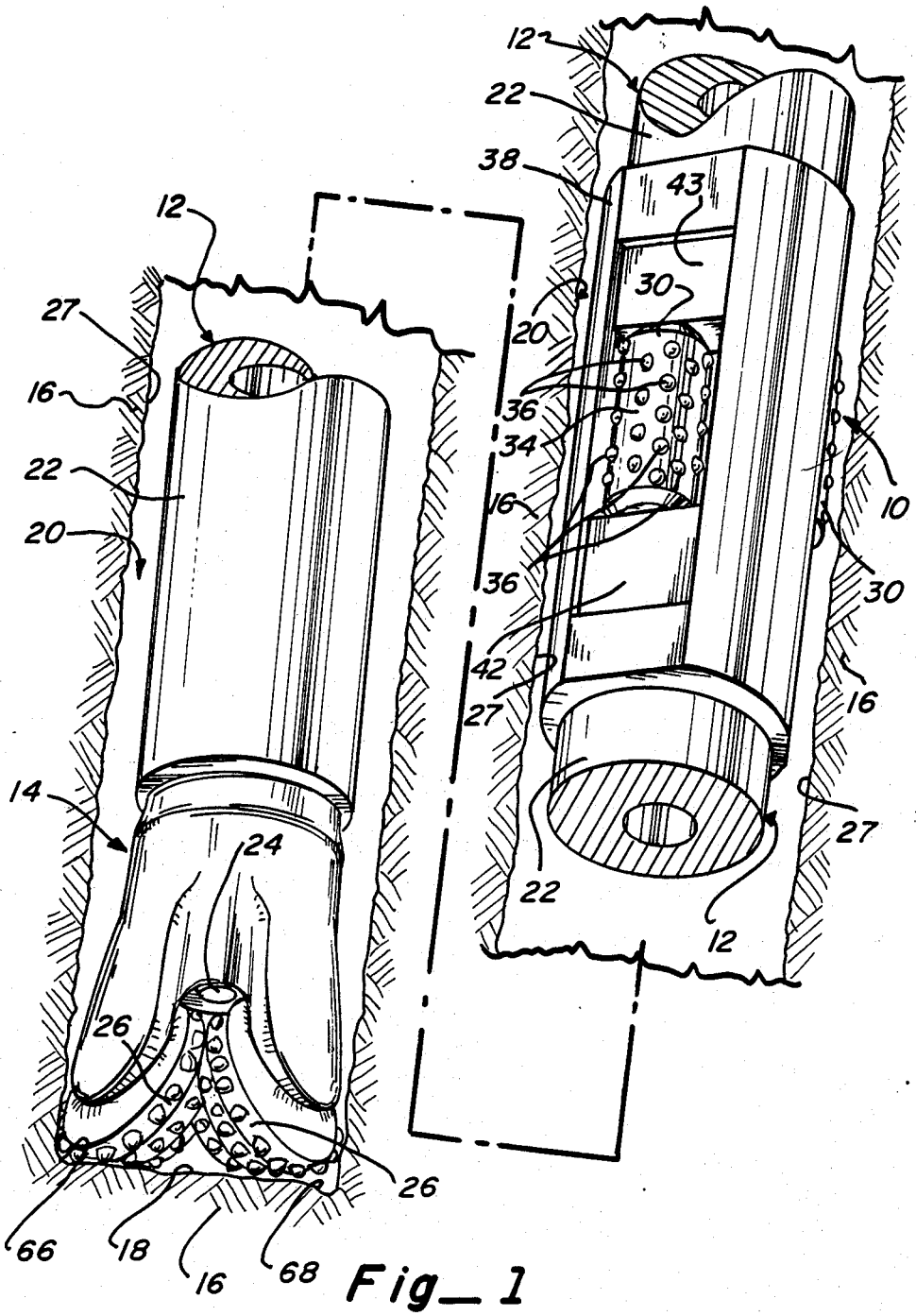
FIG. 1 is a perspective view of a drill tool embodying to the present invention, connected between drill collars in a drill string to which a drill bit is also connected, with portions of the drill string between the drilling tool and the drill bit broken away and with all the foregoing illustrated positioned in a well bore whose course is deviated from vertical.
Figure 2:
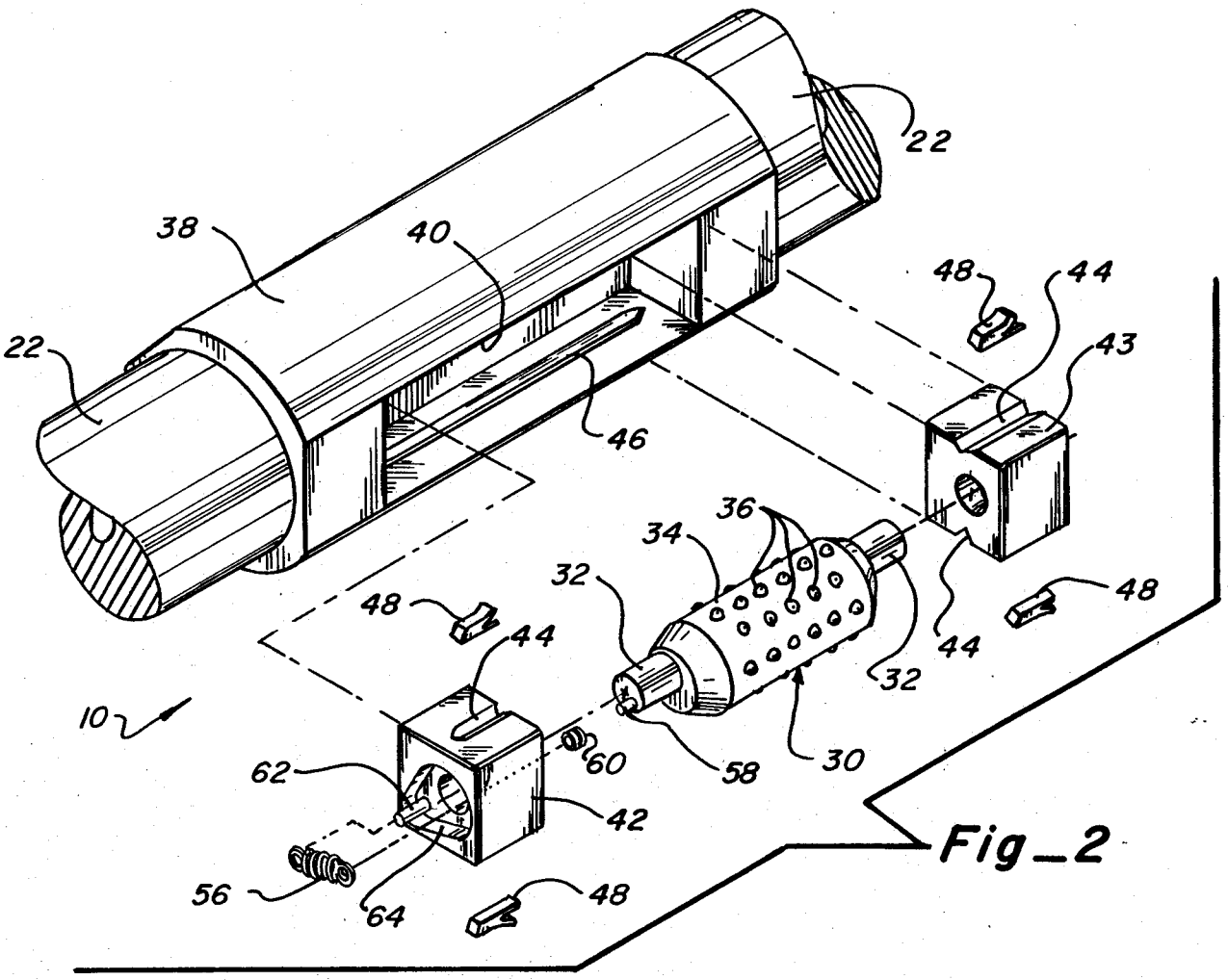
FIG. 2 is an exploded perspective view of the drill tool shown in FIG. 1, and partial views of the drill collars to which the drill tool is connected.
Figure 8:
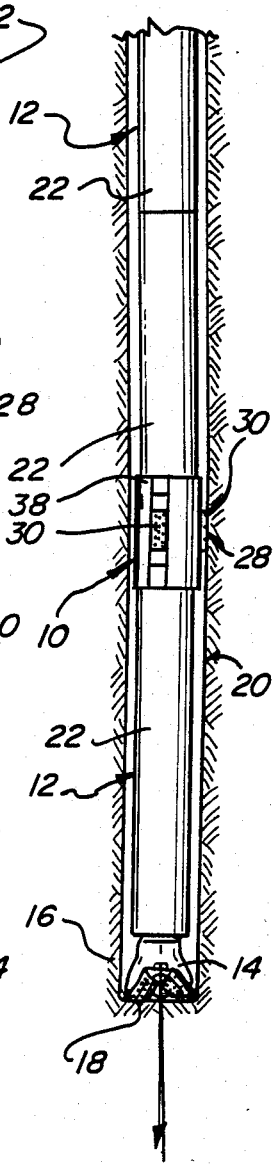
FIG. 8 is a generalize side view similar to FIG. 7 illustrating the deflection of the drill string from the low side of the well bore side wall and the bowing of the drill string to cause the lower portion of the drill string and the drill bit to advance toward the vertical, in accordance with the present invention.

The present invention is embodied in a drill tool 10, shown in the drawings. The drill tool 10 useful in eliminating, correcting or reducing well bore deviation from vertical. As is shown in FIGS. 1, 2 and 8, the drill tool 10 is positioned in a rotating drill string 12 which has a drill bit 14 connected to the bottom of the drill string 12. The drill string 12 is rotated by a drilling rig (not shown), and the drill bit 14 contacts the earth formation 16 and cuts it away at a face 18 to thereby create and advance a well bore 20 through the earth formation 16.

The diameter or gage of the well bore 20 is established by the cutting elements of the drill bit 14. The gage of the well bore 20 is greater than the diameter of the drill string 12. The drill string 12 is assembled by threading together a number of lengths of drill collars 22. The center of the drill string and each drill collar is open and thereby defines a drilling fluid passageway through which drilling fluid, known as "mud", is forced downward from the drilling rig and expelled as jets from jet orifices 24 in the drill bit 14. The jets of fluid wash away the cuttings which have been removed from the earth formation 16 by the cutting elements of the drill bit 14. The cuttings are carried by the mud upwardly out of the well bore 20 in an annulus between the exterior of the drill string 12 and a side wall 27 of the well bore 20. One type of widely used drill bit 14 illustrated in FIG. 1 is a rotary cone bit which has three cone shaped cutting wheels 26 which contact the earth formation 16 and cut or grind away the earth formation as particles or cuttings.

Figure 7:
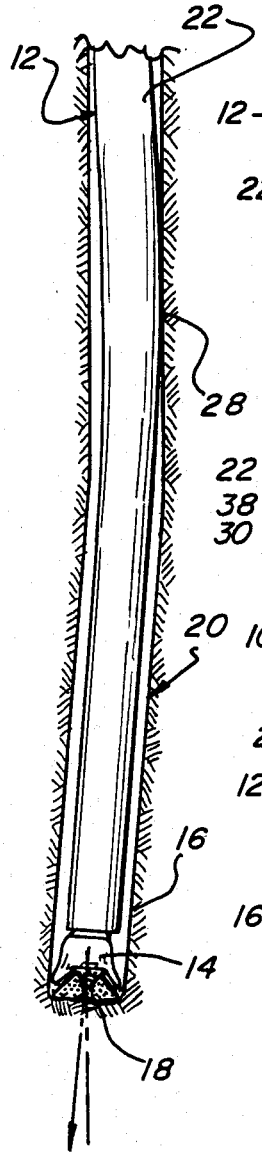
FIG. 7 is a generalized side view illustrating the effects of gravity on the drill string when the advancement of the well bore is deviated, with the drill string contacting the low side of the deviated well bore at a location above the drill bit.

In many situations it is desired to drill the well bore as vertically as possible to a predetermined subterranean location. Due to a number of factors including "dipped" or non-horizontal geological earth formations, forces may be induced on the drill bit to deviate the well bore course from vertical, as is illustrated in FIG. 7. Upon a deviation occurring, the force of gravity on the drill string and the angular orientation of the deviated well bore will cause the drill string 12 to contact a low side 28 of the well bore side wall 27 at some location above the drill bit 14. The position at which the drill string 12 contacts the low side 28 depends on a number of factors, including the weight on the drill string, the amount of deviation of the well bore, the gage of the well bore, and the diameter and flexibility of the drill collars 22.

The drill tool 10 of the present invention incorporates means which acts automatically and without specific operator intervention to eliminate, reduce or correct well bore deviation. The tool 10 is connected in the drill string 12 at a predetermined location which is determined to be that location where the drill string 12 would normally contact the low side 28 of the well bore 20 when the deviation exceeds acceptable limits, as is shown in FIGS. 7 and 8. The tool 10 includes a deflection means, described more completely below, for periodically contacting the low side 28 of the side wall and inducing a lateral deflection of the drill string away from the low side as the drill string rotates. Each time the deflection means operates, deflection of the drill string occurs. The deflection means operates on a periodic basis as the drill string rotates, and the periodic deflection induces a partial nutating effect in the drill string and causes the drill bit to cut a high edge (66, FIG. 1) of the well drill bore face more effectively than a low edge (68, FIG. 1) of the well bore face to return the well bore course to vertical, thereby eliminating or reducing the deviation.

The presently preferred embodiment of the deflection means includes a roller member 30 and means for periodically radially extending the roller 30 as it comes into contact with the low side of the well bore. Preferably a plurality of rollers 30 are located at peripherally spaced locations around the tool 10 as illustrated in FIGS. 2, 5, 6A, 6B and 6C. Each roller 30 includes an axle shaft 32 which extends from each of its ends. The axle shaft 32 is the rotational axis of the roller 30. The roller 30 also includes a contact surface 34 which, in its preferred embodiment, is generally cylindrical. An axis 50 (FIGS. 3 and 4) of the contact surface 34 is offset with respect to a rotational axis 48 of the axle shaft 32 (FIGS. 3 and 4), thereby positioning the contact surface 34 eccentrically with respect to the rotational axis 48 of the axle shaft 32. The contact surface 34 could also assume configurations other than cylindrical, and still achieve eccentricity. The contact surface 34 may include tungsten carbide buttons 36, or other forms of hard surfacing, which will withstand the abrasive effects of drilling fluid and the repeated contact of the contact surface 34 with the side wall 27 of the well bore 20.

The roller 30 is rotationally positioned in a special drill collar 38, with its rotational axis 48 parallel to the axis of the drill string, as is shown in FIGS. 1 and 2. A rectangular box like indention or housing 40 is formed in the drill collar 38. Each of the rollers 30 rotates within its own housing 40. Each roller 30 is held in the housing 40 by bearing blocks 42 and 43. The bearing blocks 42 and 43 are one example of means for rotationally connecting the axle shaft 32 to the drill collar 38. A groove 44 is formed in each of the bearing blocks 42 and 43 and groove 46 is also formed in the side wall of the housing 40. A pair of expansion keys 48 (FIG. 2) or other appropriate fastening means are inserted in the grooves 44 and 46 to hold the bearing blocks 42 and 43 in the housing 40.

Figure 4:
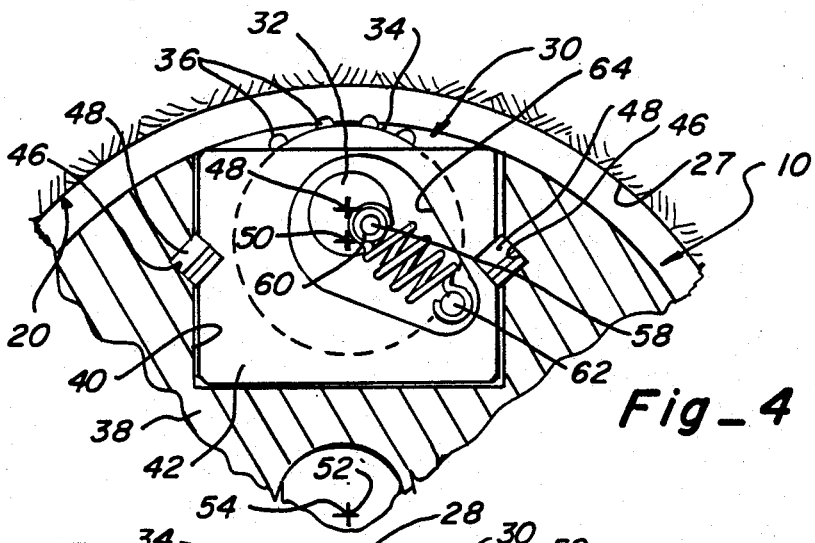
FIG. 4 is a partial cross-sectional view of the drill tool shown in FIG. 1 taken in a plane perpendicular to the rotational axis of the drill string, illustrating the normal position of the roller member relative to the side wall of the well bore.

The roller 30 is normally rotationally biased in a low position in which the low surface of the eccentric contact surface 34 faces outwardly, as is illustrated in FIG. 4. Point 48 illustrates the rotational axis of the axle shaft 32. Point 50 illustrates the axis of the contact surface 34. Since point 50 is spaced radially inward from point 48, the outward facing portion of the contact surface 34 is in its radially inwardmost or low position. The rotational axis and center point of the drill string is illustrated at point 52. The axis of the well bore is illustrated at point 54. When the drill string 12 is centered within the well bore, and the points 52 and 54 are generally coincident, and the contact surface 34 of the roller 30 does not contact the side wall 27 of the well bore 20, as is shown in FIG. 4.

Some amount of lateral movement of the drill string within the well bore is allowed before the contact surface 34 encounters the side wall 27. When the drill string bends under the influence gravity after the well bore deviates (shown in FIG. 7) the side of the drill string will encounter the low side 28 of the side wall 27. Rotation of the drill string will bring the contact surface 34 into contact with the low side 28, illustrated in FIG.

Figure 5:
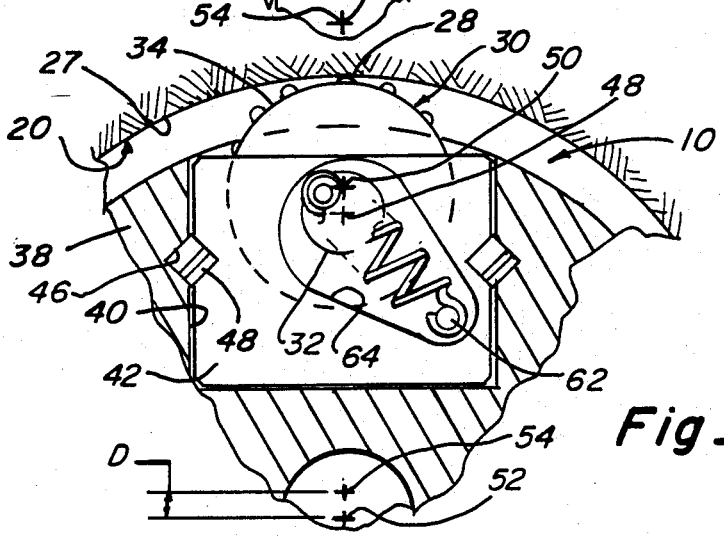
FIG. 5 is a partial cross-sectional view similar to FIG. 4, illustrating the operative position of the roller member.
Figure 6A:
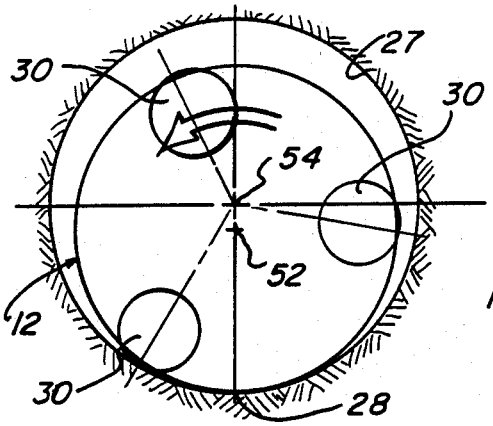
FIGS. 6A, 6B and 6C are illustrations of the operation of a roller member of the drill tool shown in FIGS. 4 and 5, illustrating the nutational effect created on the drill string.
Figure 6B:
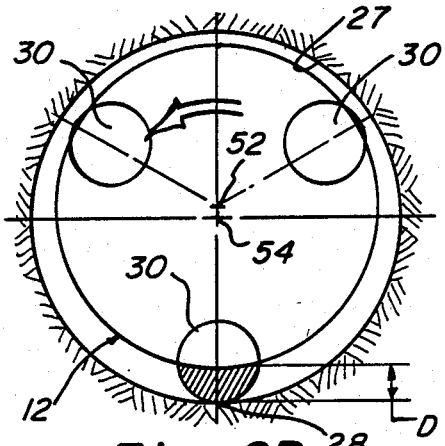

6A, causing the roller 30 to rotate about the shaft 32 for one-half of a turn and reach the high position as shown in FIGS. 5 and 6B.

In the high position of the roller 30, which is illustrated in FIGS. 5 and 6B, the contact surface 34 is in contact with the side wall 27 of the well bore 20 and the rotation of the roller 30 has forced the drill string away from the side wall 27 to deflect the drill string a distance D away from the side wall 27. The rotational axis 50 of the contact surface 34 is positioned radially outward from the rotational axis 48 of the axle shaft 32. The eccentric relationship of the contact surface 34 and the axle shaft 32 causes the contact surface 34 to position itself in its maximum radially outward or high position shown in FIG. 5.

Figure 6C:
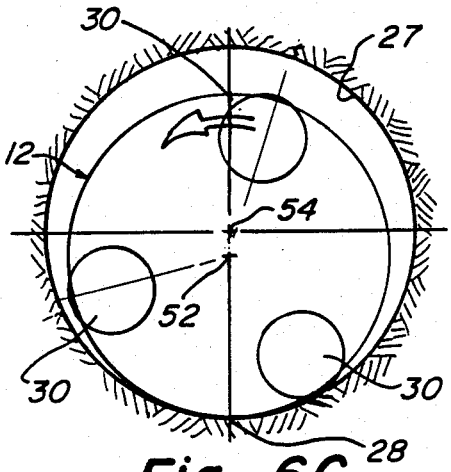

As the drill string continues to rotate, the roller 30 rotates back toward its low position, and separates from the side wall 27, as is shown in FIG. 6C. Each of the rollers 30 creates a similar effect as the roller contacts, rolls against and separates from the low side 28 of side wall 27. A partial nutating effect on the drill string is achieved, meaning that there is a vibratory displacement of the axis of the rotating drill string, which is angled from vertical due to the deviation. The usual definition of nutation is the vibratory displacement of the axis of a precessing top or gyroscope from a cone shaped figure traced by the axis during precession. Precession is a comparatively slow gyration of the rotational axis of a spinning body about another line intersecting it so as to describe a cone caused by the application of a torque tending to change the direction of the rotation axis and being a motion continuously at right angles to the plane of the torque producing it. Since the drill string does not precess to trace a cone since it is confined to the well bore, a partial nutating effect occurs on the drill string.

The eccentric relationship of the contact surface 34 with respect to the axle shaft 32 is one example of means for periodically radially extending the roller to induce the lateral deflection and the partial nutating effect in the drill string.

Figure 3:
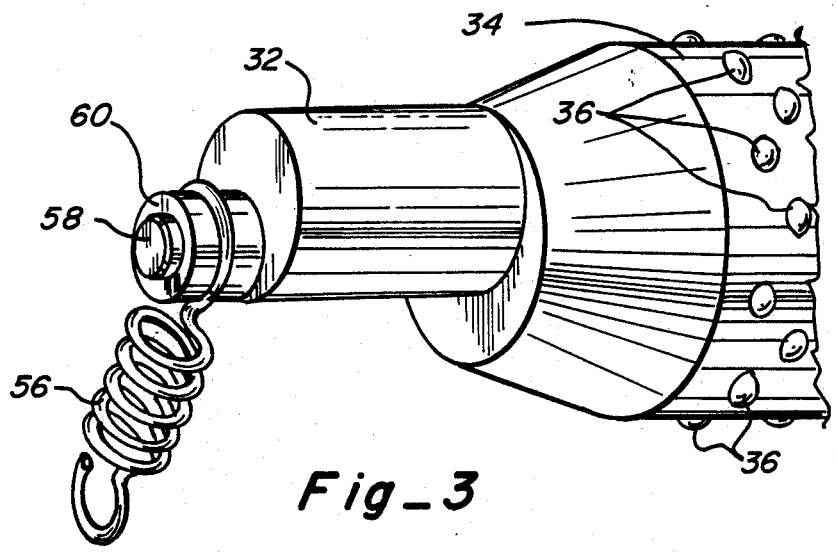
FIG. 3 is an enlarged perspective view of one end of a roller member which is an element of the drill tool shown in FIGS. 1 and 2.

Means for rotationally biasing the roller 30 to the normal low position preferably takes the form of an elongated expansion spring 56 which applies the biasing force, as is shown in FIGS. 2 to 4. A spring loading pin 58 connects to one end of the spring 56, preferably by a sleeve bearing 60. The other end of the spring 56 is connected in tension to a stationary retaining pin 62 formed in the bearing block 42. An indention 64 is formed in the bearing block 42 for the purpose of receiving and enclosing the spring 56, the pins 58 and 62, and the sleeve bearing 60. Enclosing these elements in the indention 64 allows the bearing block to fit into one end of the housing 40 (FIG. 1).

The tension from the spring 56 operates between the stationary retaining pin 62 and the spring loading pin 58. This force normally tends to pull the pins 58 and 62 to their closest position, to thereby rotationally bias the roller 30 in the low position. The location of pin 58 relative to the high and low positions of the eccentrically located contact surface 34 and the pin 62 is selected so that the low position of the contact surface 34 is achieved when the shortest distance exists between the pins 58 and 62. Thus the roller 30 is normally biased with the low position of the contact surface 34 facing outwardly of the drill string.

As is illustrated in FIG. 8, the drilling tool 10 of the present invention is normally positioned at a predetermined location in the drill string 12 where the drill string would normally contact the low side 28 of the deviated well bore 20. As the drill string rotates, each roller 30 moves into contact with the low side 28. Continued rotation of the drill string causes the contact surface 34 to roll along the low side 28 of the side wall 27 until the roller achieves the high position illustrated in FIGS. 5, 6B and 8. In this position, the eccentric action of the roller has forced the drill string 12 away from the low side 28 of the well bore. This deflection D (FIGS. 5 and 6B) tends to straighten the drill string as is illustrated in FIG. 8. If the drill string is not completely straightened, a periodic lateral impulse or deflection is induced by each of the rollers into the drill string, and this periodic lateral force tends to bow or deflect the drill string so that the lower portion and the drill bit approaches vertical. As is illustrated in FIG. 1, as the lower end of the drill string and the drill bit bow toward vertical, the drill bit is more effective in cutting the high edge 66 of the well bore face 18 than the drill bit is effective in cutting the low edge 68 of the well bore face 18. As a consequence, the well bore advances more toward the vertical thus reducing and ultimately eliminating or correcting the well bore deviation. Once the well bore deviation is corrected, the rollers 30 no longer contact the side wall of the well bore. The bit can advance in its normal manner under such circumstances without the influence of the drill tool 10. However, as soon as another deviation occurs, the tool 10 becomes effective on an automatic basis to eliminate or correct the deviation.

The amount of lateral deflection induced is generally related to the amount of well bore deviation. For small amounts of deviation the contact surface 34 of the roller first contacts the side wall 27 near the low side 28 and only rotates a small amount before the rotation of the drill string brings the roller 30 out of contact with the side wall. The roller 30 does not rotate enough to achieve the high position shown in FIG. 5, but does rotate enough to induce an amount of deflection less than the maximum to the drill string. As the amount of well bore deflection increases the amount of induced lateral deflection also increases until the maximum amount D (FIG. 5) is achieved.

Another technique of using the tool 10 is to place a full-gage stabilizer (not shown) in the drill string between the drill bit 14 and the drill tool. The stabilizer servers as a fulcrum, and the lateral impulses force the drill string below the stabilizer to angle the bit toward vertical.

In addition to the primary advantage of correcting or reducing well bore deviation, the tool 10 of the present invention also has the advantageous effect of automatically responding without reductions in the penetration rate, and without "tripping" to install special stabilizers, or other known devices for correcting the deviation. Furthermore, once the deviation is corrected, the tool 10 automatically becomes ineffective so that the drilling can continue on a vertical course. This is in contrast to the previous arrangements of using special equipment, which may require "tripping" to remove the equipment.

A practical consequence of the present invention is that it makes drilling for marginal producing prospects more attractive, since the cost of drilling the well bore on a predetermined vertical course is reduced. This is particularly important in those areas where the geological formations and other forces which tend to induce deviations make drilling for marginal producing prospects unattractive.

Details of the present invention have been shown and described with a degree of particularity. It should be understood, however, that the foregoing detailed description has been made by way of preferred example, and that the actual scope of the present invention is defined by the following appended claims.

What is claimed:

1. A drill tool for use in a rotary drill string at a predetermined location spaced above a drill bit connected to the bottom of the drill string, said drill tool operatively reducing or eliminating the deviation of the well bore from vertical as the well bore is advanced by the drill bit during rotation of the drill string, said drill tool comprising:

deflection means connected to the drill string at the predetermined location for periodically contacting the low side of a side wall of a well bore which deviates from vertical and for inducing a lateral deflection of the drill string away from the low side of the side wall as the drill string rotates to create a partial nutating effect in the drill string; and connection means for connecting the deflection means in the drill string at the predetermined location spaced above the drill bit to cause the lateral deflection and the partial nutating effect to bow the drill string away from the low side and to angle the lower portion of the drill string and drill bit toward vertical; and said deflection means further comprises:

a roller rotationally connected to the drill string at a position to rotate against the low side of the side wall as the drill string rotates; and means for periodically radially extending the roller as it comes in contact with the low side to force the drill string away from the low side and induce the lateral deflection in the drill string.

2. A drill tool for use in a rotary drill string at a predetermined location spaced above a drill bit connected to the bottom of the drill string, said drill tool operatively reducing or eliminating the deviation of the well bore from vertical as the well bore is advanced by the drill bit during rotation of the drill string, said drill tool comprising:

deflection means connected to the drill string at the predetermined location for periodically contacting the low side of a side wall of a well bore which deviates from vertical and for inducing a lateral deflection of the drill string away from the low side of the side wall as the drill string rotates to create a partial nutating effect in the drill string; and connection means for connecting the deflection means in the drill string at the predetermined location spaced above the drill bit to cause the lateral deflection and the partial nutating effect to bow the drill string away from the low side and to angle the lower portion of the drill string and drill bit toward vertical;

said deflection means comprises a roller comprising an axle shaft having an axis about which said roller rotates, and an outer contact surface positioned eccentrically with respect to the axle shaft; and said connection means further comprises means for rotatably connecting the axle shaft to a length of drill string at the predetermined location with the rotational axis of the axle shaft substantially parallel to the rotational axis of the drill string.

3. A drill tool as defined in claim 2 wherein:

the eccentric position of the contact surface relative to the axle shaft establishes a high position where the contact surface is spaced a maximum distance from the rotational axis of the axle shaft, and a low position where the contact surface is spaced a minimum distance from the rotational axis of the axle shaft; and said deflection means further comprises bias means for normally rotationally biasing the roller means with the low position facing outward of the drill string.

4. A drill tool as defined in claim 3 wherein: the predetermined location is one where gravity would normally pull the drill string into contact with the low side of a deviated well bore; and the eccentric relationship of the contact surface and the axle shaft operatively forces the drill string away from the low side of the side wall of the well bore upon the roller rolling with the contact surface in contact with the low side of the side wall during rotation of the drill string.

5. A drill tool as defined in claim 4 wherein:

the distance from the contact surface of the roller in the low position to the axis of the drill string is less than one-half the gage or diameter of the well bore cut by the drill bit.

6. A drill tool as defined in claim 4 wherein:

said connection means operatively connects a plurality of circumferentially spaced deflection means to the length of the drill string at the predetermined location.

7. A drill tool as defined in claim 3 wherein the bias means further comprises:

means for applying a biasing force; and means eccentrically connected to the axle shaft and receptive of the bias force from the bias force applying means and operative for rotating the roller means to a normal position where the low position of the contact surface faces outward of the drill string.

8. A drill tool as defined in claim 3 wherein said bias means further comprises:

an elongated spring operative for applying tension force between its ends;

a spring loading pin eccentrically positioned relative to the rotational axis of the axle shaft of the roller and also positioned at a predetermined location relative to the low position of the roller;

means for rotatably connecting one end of the spring to the spring loading pin;

means for connecting the other end of the spring to a stationary location on the drill tool; and the relative position of the spring loading pin and the stationary location forcing the roller to assume a normal rotational position where the low position of the roller faces outwardly.

9. A drill tool for use in a rotating drill string at a predetermined location spaced above the drill bit connected to the bottom of the drill string, said drill tool operatively reducing or eliminating the deviation of the well bore from vertical as the well bore is advanced by the drill bit during the rotation of the drill string, said drill tool comprising:

a roller comprising an axle shaft having an axis about which said roller rotates, and an outer contact surface which is positioned eccentrically with respect to the axle shaft, the eccentric position establishing a high position where the contact surface is spaced a maximum distance from the rotational axis of the drill string and a low position where the contact surface is spaced a minimum distance from the rotational axis of the drill string;

means for rotatably connecting the axle shaft of the roller to a length of drill string at the predetermined location with the rotational axis of the axle shaft substantially parallel to the rotational axis of the drill string, the predetermined location being one where gravity would normally pull the drill string into contact with the low side of a side wall of a deviated well bore;

bias means for normally rotationally biasing the roller means with the low position facing outwardly of the drill string; and the eccentric relationship of the contact surface and the axle shaft forcing the drill string away from the low side of the side wall upon the contact surface in its low position coming into contact with and rolling along the side wall to induce a lateral deflection of the drill string away from the low side as the drill string rotates, the predetermined location of the roller and the lateral deflection of the drill string due to the eccentrically induced force upon rotation of the roller in contact with the low side of the side wall causing the drill string to experience a partial nutating effect and to bow away from the low side of the well bore and to angle the lower portion of the drill string and drill bit toward vertical.

10. A drill tool as defined in claim 9 wherein:

the distance from the contact surface of the roller in its low position to the rotational axis of the drill string is less than one-half the gage or diameter of the well bore cut by the drill bit.

* * * * *